US005513883A

United States Patent [19]

Segla

[11] Patent Number: 5,513,883

[45] Date of Patent: May 7, 1996

[54] ASH REMOVING IMPLEMENT

[76] Inventor: Thomas J. Segla, 111 Dunn Ave., Naugatuck, Conn. 06770

[21] Appl. No.: 386,149

[22] Filed: Feb. 9, 1995

[51] Int. Cl.[6] ..... F23J 1/04

[52] U.S. Cl. ..... 294/9; 294/55

[58] Field of Search ..... 294/9, 10, 50.8, 294/50.9, 55, 57, 1.4; 126/242–245; 15/257.1, 257.6, 257.7

[56] References Cited

U.S. PATENT DOCUMENTS

| | | | |
|---|---|---|---|
| 507,826 | 10/1893 | Miller | 294/55 |
| 777,963 | 12/1904 | Link | 294/50.9 |
| 1,762,347 | 6/1930 | Peebles | 294/55 |
| 3,601,966 | 8/1971 | Kerry | 294/50.9 |
| 4,214,784 | 7/1980 | Rogalski | 294/9 |
| 4,299,419 | 11/1981 | Kalan | 294/9 |
| 4,305,376 | 12/1981 | Neugent | 294/9 |
| 4,378,671 | 4/1983 | Gascon | 294/50.9 |
| 4,457,548 | 7/1984 | Robins et al. | 294/9 |
| 4,572,560 | 2/1986 | Grandlouis | 294/9 |

*Primary Examiner*—Dean Kramer

[57] ABSTRACT

An implement for receiving and containing ashes during cleaning of a stove or fireplace. The inventive device includes a collection box for scooping and receiving ashes. A closure is pivotally mounted to the box for containing the ashes therewithin. A handle assembly extends from the box for facilitating manual manipulation of the box and operation of the closure.

3 Claims, 3 Drawing Sheets

ASH REMOVING IMPLEMENT

BACKGROUND OF THE INVENTION

1. Field of the Invention

The present invention relates to cleaning devices and more particularly pertains to an ash removing implement for receiving and containing ashes during cleaning of a stove or fireplace.

2. Description of the Prior Art

The use of cleaning devices is known in the prior art. More specifically, cleaning devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art cleaning devices include U.S. Pat. Nos. 4,299,419; 4,361,245; 4,381,761; 4,402,538; 4,619,474; and 4,659,123.

While these devices fulfill their respective, particular objectives and requirements, the aforementioned patents do not disclose an ash removing implement for receiving and containing ashes during cleaning of a stove or fireplace which includes a collection box for scooping and receiving ashes, a closure pivotally mounted to the box for containing the ashes therewithin, and a handle assembly extending from the box for facilitating manual manipulation of the box and operation of the closure.

In these respects, the ash removing implement according to the present invention substantially departs from the conventional concepts and designs of the prior art, and in so doing provides an apparatus primarily developed for the purpose of receiving and containing ashes during cleaning of a stove or fireplace.

SUMMARY OF THE INVENTION

In view of the foregoing disadvantages inherent in the known types of cleaning devices now present in the prior art, the present invention provides a new ash removing implement construction wherein the same can be utilized for receiving and containing ashes during cleaning of a stove or fireplace. As such, the general purpose of the present invention, which will be described subsequently in greater detail, is to provide a new ash removing implement apparatus and method which has many of the advantages of the cleaning devices mentioned heretofore and many novel features that result in a ash removing implement which is not anticipated, rendered obvious, suggested, or even implied by any of the prior art cleaning devices, either alone or in any combination thereof.

To attain this, the present invention generally comprises an implement for receiving and containing ashes during cleaning of a stove or fireplace. The inventive device includes a collection box for scooping and receiving ashes. A closure is pivotally mounted to the box for containing the ashes therewithin. A handle assembly extends from the box for facilitating manual manipulation of the box and operation of the closure.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ash removing implement apparatus and method which has many of the advantages of the cleaning devices mentioned heretofore and many novel features that result in a ash removing implement which is not anticipated, rendered obvious, suggested, or even implied by any of the prior art cleaning devices, either alone or in any combination thereof.

It is another object of the present invention to provide a new ash removing implement which may be easily and efficiently manufactured and marketed.

It is a further object of the present invention to provide a new ash removing implement which is of a durable and reliable construction.

An even further object of the present invention is to provide a new ash removing implement which is susceptible of a low cost of manufacture with regard to both materials and labor, and which accordingly is then susceptible of low prices of sale to the consuming public, thereby making such ash removing implements economically available to the buying public.

Still yet another object of the present invention is to provide a new ash removing implement which provides in the apparatuses and methods of the prior art some of the advantages thereof, while simultaneously overcoming some of the disadvantages normally associated therewith.

Still another object of the present invention is to provide a new ash removing implement for receiving and containing ashes during cleaning of a stove or fireplace.

Yet another object of the present invention is to provide a new ash removing implement which includes a collection box for scooping and receiving ashes, a closure pivotally mounted to the box for containing the ashes therewithin, and a handle assembly extending from the box for facilitating manual manipulation of the box and operation of the closure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
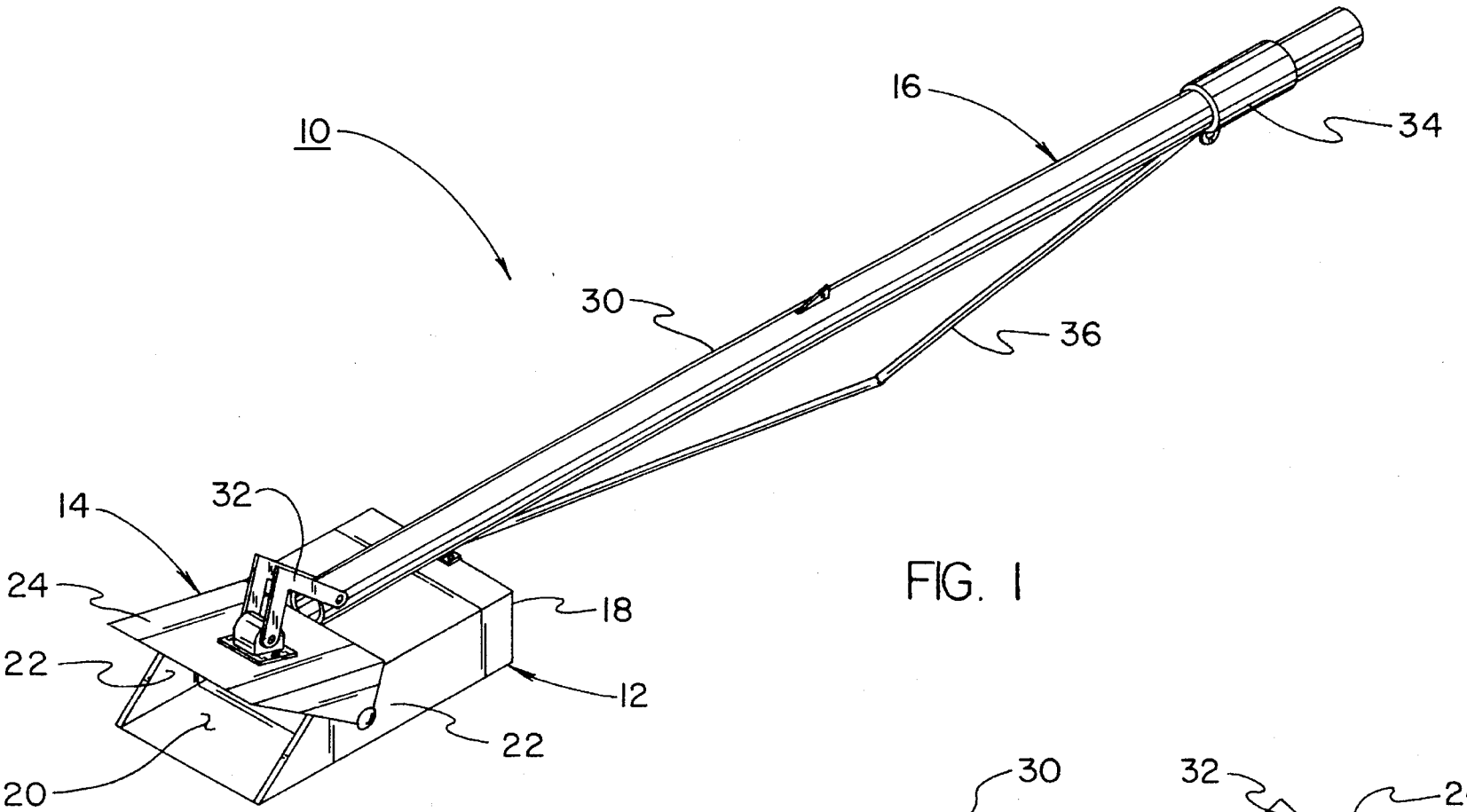
FIG. 1 is an isometric illustration of an ash removing implement with a closure means thereof in an open position.

With reference now to the drawings, and in particular to FIGS. 1–7 thereof, a new ash removing implement embodying the principles and concepts of the present invention and generally designated by the reference numeral 10 will be described.

More specifically, it will be noted that the ash removing implement 10 comprises a collection means 12 for receiving and containing ashes during a cleaning procedure. A closure means 14 is pivotally mounted to the collection means 12 for containing ashes therewithin. A handle means 16 is mounted to the collection means 12 for facilitating manual manipulation of the collection means and operation of the closure means 14 by an individual.

Figure 2:
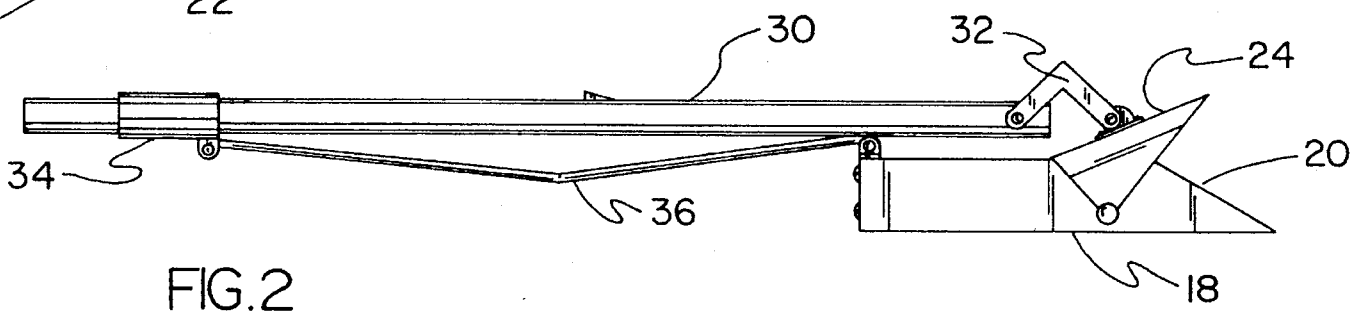
FIG. 2 is a side elevation view of the invention in the open position.

As best illustrated in FIGS. 1 and 2, it can be shown that the collection means 12 according to the present invention 10 comprises a substantially rectangular collection box 18 having an unlabeled closed end spaced from an angled opening 20 through which the ashes can be positioned during sliding of the collection box 18 within a stove or fireplace. The collection box 18 includes opposed side walls 22 to which the closure means 14 is pivotally mounted. By this structure, a sliding of the collection box 18 along a floor of a fireplace will guide the ashes through the angled opening 20 for reception within the collection box 18.

Figure 6:
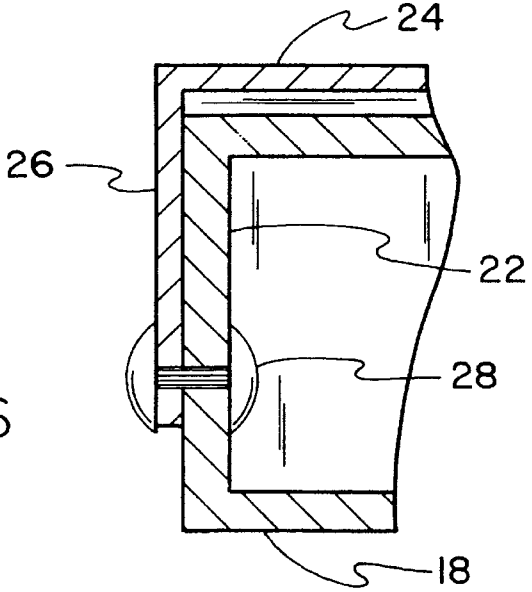
FIG. 6 is a cross sectional view taken along line 6—6 of FIG. 3.

As shown in FIG. 6 with concurrent reference to FIGS. 1 through 4, it can be shown that the closure means 14 according to the present invention 10 preferably comprises substantially rectangular cover lid 24 having opposed transverse edges from which a pair of pivot plates 26 respectively extend. The pivot plates are each pivotally mounted to an individual one of the side walls 22 by a pivot pin 28 extending therethrough. By this structure, the cover lid 24 of the closure means 14 can be selectively pivoted so as to cover the angled opening 20 of the collection box 18 to contain ashes securely within the collection box.

Figure 3:
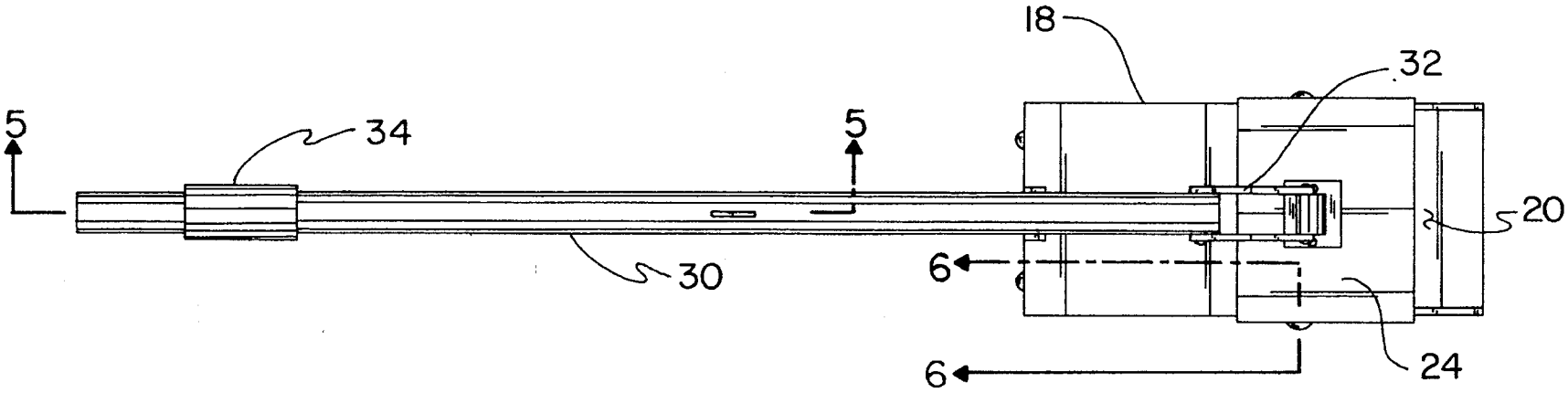
FIG. 3 is a top plan view of the invention.
Figure 4:
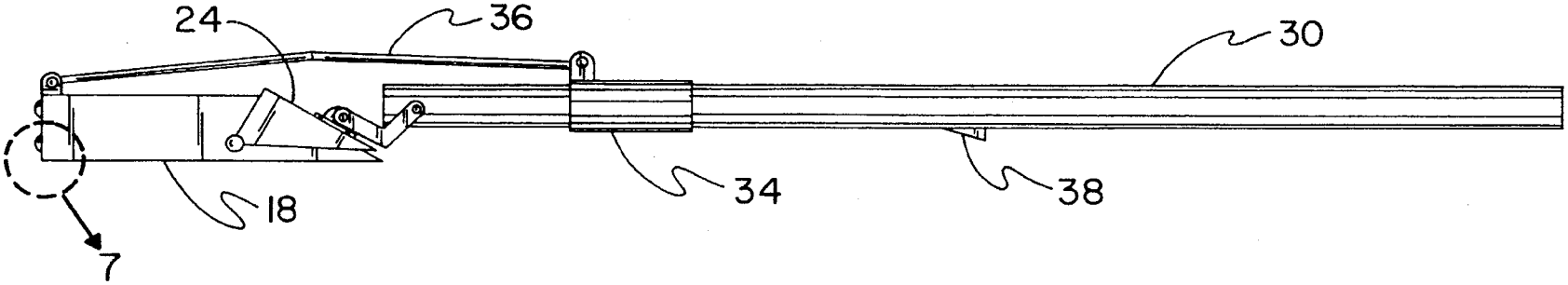
FIG. 4 is a side elevation view of the present invention in a storage position.
Figure 5:
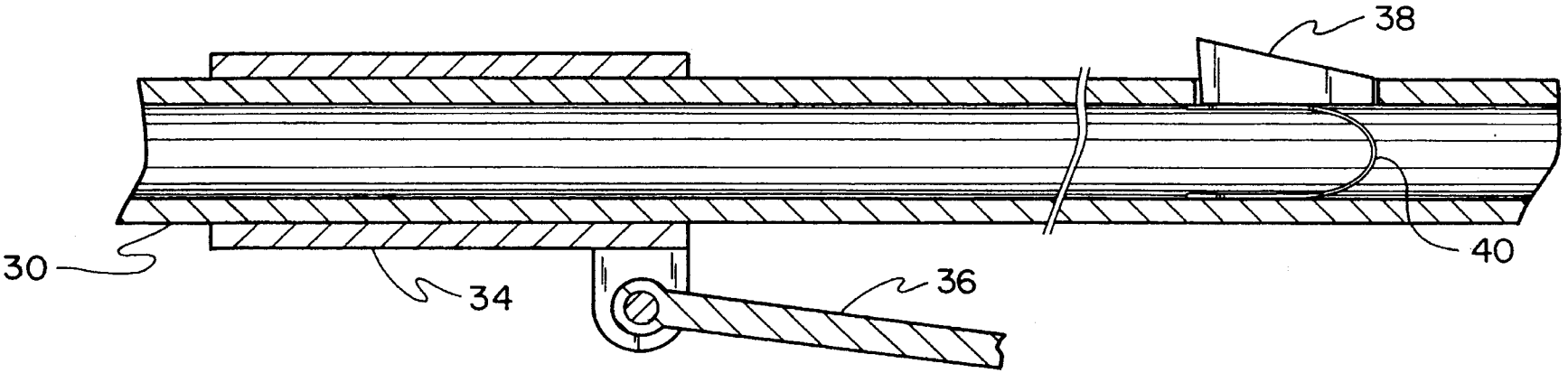
FIG. 5 is a cross sectional view taken along line 5—5 of FIG. 3.

Referring now to FIG. 5 with concurrent reference to FIG. 1 through 4, it can be shown that the handle means 16 according to the present invention 10 comprises an elongated handle 30 of preferably tubular configuration which is coupled to the closure means 14 by at least one connecting lever 32. To this end, the connecting lever 32 is pivotally mounted to the cover lid 24 and to a first end of the elongated handle 30. The handle means 16 further comprises a sliding grip 34 concentrically and slidably positioned over the elongated handle 30 which is mechanically coupled to the collection box 18 of the collection means 12 by a push rod 36 pivotally mounted therebetween. By this structure, a relative movement of the elongated handle 30 and the sliding grip 34 will effect pivoting of the closure means 14 as desired, with a concurrent movement of the elongated handle and the sliding grip effecting manual manipulation of the entire device 10.

To limit sliding movement of the sliding grip 34 relative to the elongated handle 30 beyond a predetermined portion of the elongated handle, the handle means 16 according to the present invention 10 further comprises a detent wedge 38 movably mounted to the elongated handle 30 and projecting through an unlabeled aperture thereof. The detent wedge 38 is supported within the aperture of the elongated handle 30 as shown in FIG. 5, by an arcuate leaf spring 40. The detent wedge 38 operates to selectively preclude sliding positioning of the grip 34 beyond a predetermined portion of the elongated handle 30. The detent 38 can be selectively depressed into the elongated handle 30 to permit the sliding grip 34 to be positioned thereover as desired and as shown in FIG. 4.

Figure 7:
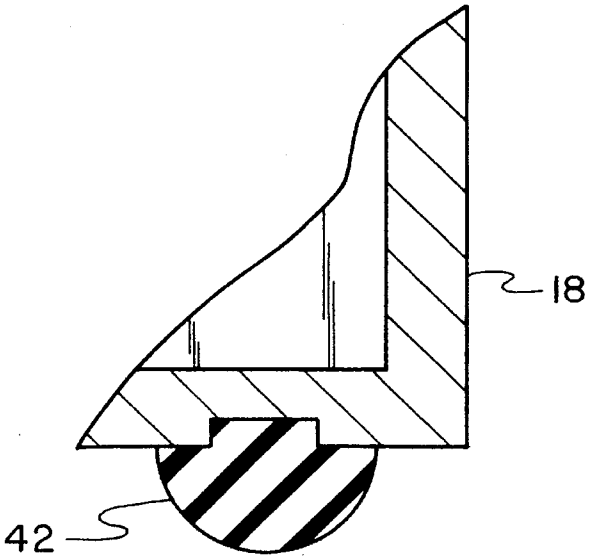
FIG. 7 is a cross sectional view of the area set forth in FIG. 4.

As shown in FIG. 7, the collection box 18 of the collection means 12 can be provided with a plurality of resilient feet 42 if desired.

In use, the present invention 10 can be utilized to remove ashes from a fireplace or stove during a cleaning procedure thereof. To this end, the collection box 18 of the collection means 12 may be slid across a floor of the fireplace or stove, whereby a positioning of the closure means 14 in the open position as shown in FIG. 1 through 3 will permit ashes to be directed into the collection box. The closure means 14 can then be manually closed through a manipulation of the handle 16 to effectively contain the ashes within the collection box 18. During storage or transportation of the device 10 to a remote location for dumping of the ashes contained therein, the device may be positioned into the storage position illustrated in FIG. 4. To this end, the detent wedge 38 can be selectively depressed into the elongated handle 30, whereby a sliding positioning of the grip 34 beyond the detent wedge 38 towards the collection means 12 will effect inversion thereof relative to the elongated handle 30, whereby the handle means 16 can be carried in a depending manner by an individual. Preferably, the resilient feet 42 as shown in FIGS. 4 and 7, extend along the closed rear end of the collection box 18 such that the device 10 may be stored in a vertical position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An ash removing implement comprising:

a collection means having a collection box with a closed end spaced from an angled opening through which ashes can be positioned during sliding of the collection box within a stove, said collection box including opposed side walls to which a closure means is pivotally mounted;

a closure means comprising a substantially rectangular cover lid having opposed transverse edges; a pair of pivot plates extending from the transverse edges of said rectangular cover with each of said pivot plates being pivotally mounted to an individual one of the side walls of said collection box; and, a handle means mounted to said collection means for facilitating manual manipulation of said collection means and for operation of said closure means, said handle means comprising an elongated handle pivotally coupled to the closure means; a sliding grip concentrically and slidably positioned over the elongated handle; and a push rod for mechanically coupling the sliding grip to the collection box of the collection means, wherein a relative movement of the elongated handle and the sliding grip will effect pivoting of the closure means, with a concurrent movement of the elongated handle and the sliding grip effecting manual manipulation of the implement.

2. The ash removing implement of claim 1, wherein the handle means comprises a detent wedge movably mounted to the elongated handle and projecting through an aperture thereof to limit sliding movement of the sliding grip relative to the elongated handle beyond a predetermined portion of the elongated handle.

3. The ash removing implement of claim 2, wherein the detent wedge is supported within the aperture of the elongated handle by an arcuate leaf spring.

* * * * *